US005265509A

United States Patent [19]

Chen

[11] Patent Number: 5,265,509

[45] Date of Patent: Nov. 30, 1993

[54] AUTOMATIC TISSUE SUPPLIER FOR PROVIDING MOISTURIZED TISSUE

[76] Inventor: Ming-Shen Chen, c/o Hung Hsing Patent Service Center, P.O. Box 55-1670, Taipei (10477), Taiwan

[21] Appl. No.: 997,174

[22] Filed: Dec. 28, 1992

[51] Int. Cl.[5] ..... B26D 5/20

[52] U.S. Cl. ..... 83/282; 83/459; 242/56 R

[58] Field of Search ..... 221/30, 150 HC, 150 R, 221/135, 9, 10; 83/282, 452, 459, 382, 648; 242/56 R

[56] References Cited

U.S. PATENT DOCUMENTS 4,192,208 3/1980 Muker et al. ..... 83/459
4,382,836 5/1983 Frank ..... 83/282
4,783,967 11/1988 Mullen ..... 221/150 HC

FOREIGN PATENT DOCUMENTS 48412 12/1984 Netherlands ..... 221/30

*Primary Examiner*—H. Grant Skaggs
*Assistant Examiner*—Kenneth Noland

[57] ABSTRACT

An automatic tissue supplier includes a container stored with folded or wound tissue strip, a water-spray system operatively spraying water for instantly moisturizing the tissue immediately extended by a driving motor, a warming and cooling device for selectively warming or cooling the water before being delivered to the spray nozzle for making warm or cool moisturized tissue, and a cutter operatively cutting the tissue in a predetermined length ready for a "fresh" use of moisturized tissue.

7 Claims, 4 Drawing Sheets

AUTOMATIC TISSUE SUPPLIER FOR PROVIDING MOISTURIZED TISSUE

BACKGROUND OF THE INVENTION

Holtsch disclosed a dispensing container in his U.S. Pat. No. 4,899,905 which includes a container with a strip of continuous premoisturized swabs therein, each swab being rectangular and interconnected with adjacent swabs at their respective corners. The swabs are folded only at their interconnection location and stacked one on top of the other. The container has an end face with an opening, through which a portion of the uppermost swab extends. The container also has a lid to protect the portion of the uppermost swab extending through the opening. Each swab is removable individually by pulling vertically on the portion of the uppermost swab until it tears at the interconnection location with the successive swab, because of frictional resistance generated by accumulation of the successive swab in the opening being greater than the tear strength of the interconnection location.

However, such a conventional dispensing container may still have the following drawbacks:

1. The swabs are premoisturized as stacked in the closed container, thereby being easily mildewed especially when stored for a long time for influencing health and hygiene for the use of the swabs.

2. It is suitable for mass production in a factory for making the containers each filled such a premoisturized swabs. After using up the swabs, the container shall be disposed to cause environmental problem.

The present inventor has found the drawbacks of the conventional dispensing container and invented the present automatic tissue supplier.

SUMMARY OF THE INVENTION the object of the present invention is to provide a tissue supplier which may provide tissue with instant spray of water whenever using for preventing the mildew problem.

According to the present invention there is provided with an automatic tissue supplier including a container stored with folded or wound tissue strip, a water-spray system operatively spraying water for instantly moisturizing the tissue immediately extended by a driving motor, a warming and cooling device for selectively warming or cooling the water before being delivered to the spray nozzle for making warm or cool moisturized tissue, and a cutter operatively cutting the tissue in a predetermined length ready for a "fresh" use of moisturized tissue.

DETAILED DESCRIPTION

Figure 1:
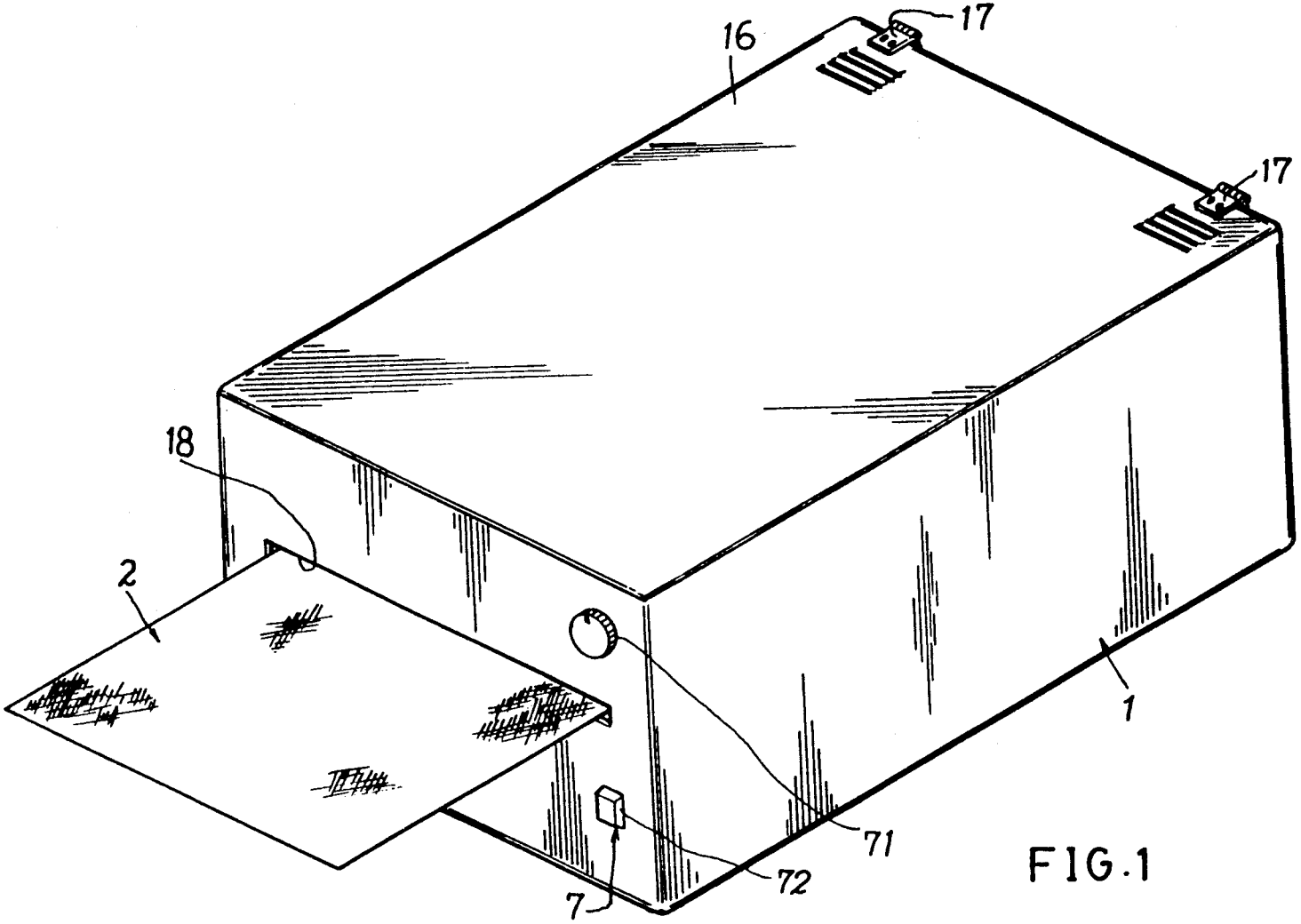
FIG. 1 is a perspective view of the present invention.

As shown in the drawing figures, the present invention comprises: a container 1, a tissue strip 2 folded or wound in the container, a moisturizing system 3, a warming and cooling means 4, a tissue extending means 5, a cutting means 6, and a control means 7.

The container 1 generally parallelepiped shaped includes: a tissue compartment 11 formed in a central portion of the container 1 for storing folded tissue strap 2 therein, a water compartment 12 formed in a side portion of the container for filling sterilized water therein, a heat-exchanger compartment 13 positioned above the water compartment 12 for installing the warming and cooling means 4 therein, a motor compartment 14 formed in a front portion of the container for securing a driving motor 50 of the tissue extending means 5 therein, a dispensing compartment 15 positioned above the motor compartment 14 for providing a spray nozzle 34 of the moisturizing system 3 and the cutting means 6 in the dispensing compartment 15, an upper lid 16 pivotally secured to an upper portion of the container 1 by hinge 17 for sealing an upper opening of the container, which is provided for re-filling the tissue strip 2 into the container 1, and a dispensing port 18 slotted in a front panel 10 formed on a front portion of the container 1 for discharging cut tissue.

The tissue strip 2 may be folded, stacked in the tissue compartment 11. Also, the tissue strip 2 may be wound to form a paper reel rotatably mounted in the container 1, not limited in this invention. The tissue strip 2 is extended outwardly through a guiding roller set 21 comprised of a plurality of guiding rollers rotatably mounted on the container 1. The tissue is made of water-absorbent paper or cloth.

Figure 3:
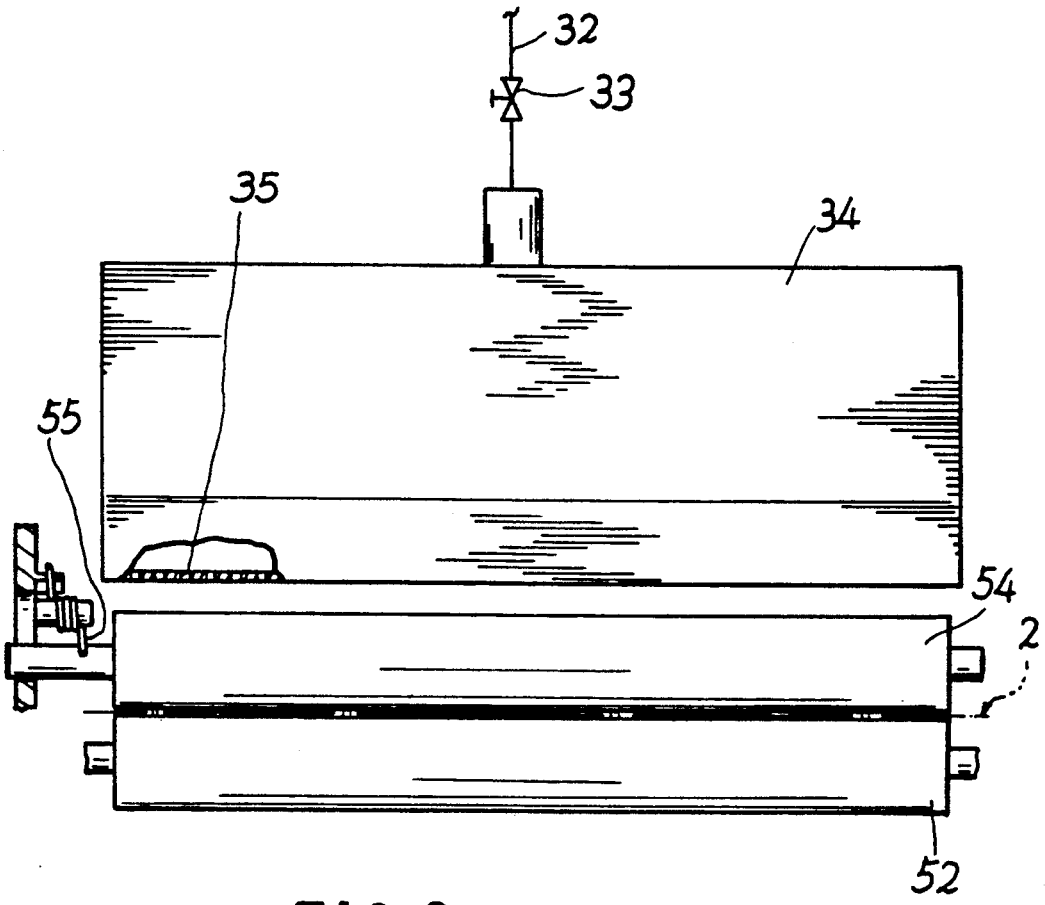
FIG. 3 shows a spray nozzle and the relevant rollers in accordance with the present invention.

The moisturizing system 3 includes: a pump 31 installed in the water compartment 12 for sucking and pumping water 30 filled in the water compartment 12, a water conduit 32 connected from the pump 31 to a spray nozzle 34 formed in the dispensing compartment, an adjusting valve 33 (for adjusting water flow rate in the conduit 32) formed in the water conduit 32, with the spray nozzle 34 drilled with a plurality of perforations 35 as shown in FIG. 3 for spray water drops for moisturizing the tissue 2.

The water compartment 12 is provided with a feed valve **30*a* for filling sterilized water 30 into the compartment 12 and a drain valve 30*b* on a bottom portion of the compartment 12 for draining washed water when washing the compartment 12**.

The warming and cooling means 4 includes: a heater and a cooler installed in the heat-exchanger compartment 13 for selectively warming the water flowing through a first branch conduit (not shown) passing through the heater, or for cooling the water flowing through a second branch conduit (not shown) passing through the cooler, thereby selectively producing warming water suitable for winter season use or producing cold water for use in summer season.

Figure 2:
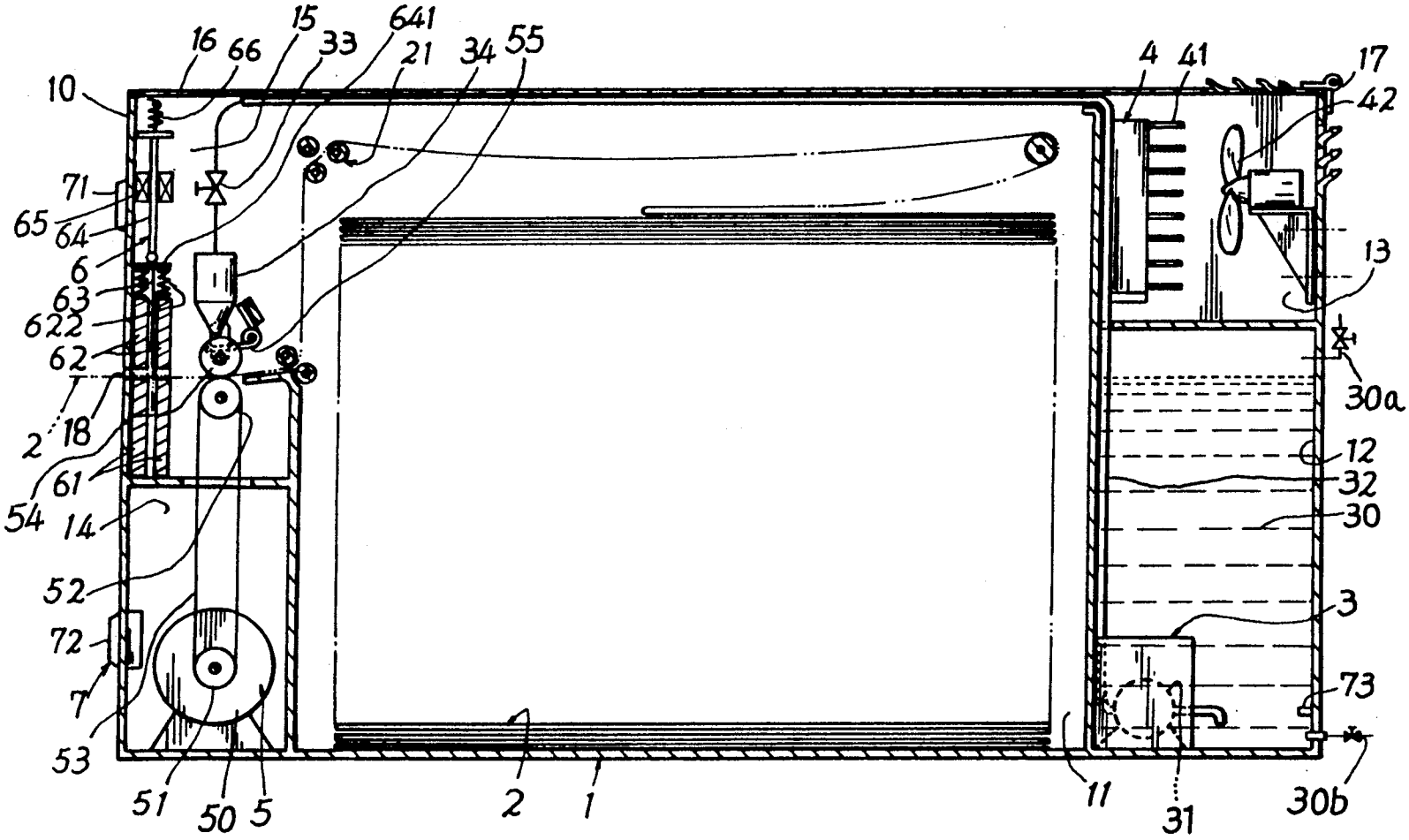
FIG. 2 is a sectional drawing of the present invention.

As shown in FIG. 2, the cooler of the warming and cooling means 4 may be a chip type or semiconductor cooler having fins 41 for radiating heat outwardly as effected by an exhausting fan 42 mounted in the container 1 for sucking hot air outwardly, thereby cooling water passing through the conduit 32. Other coolers or freezers may also be used in this invention.

The heater may be a heating coil or a PTCS (positive-temperature-coefficient semiconductor) heating element, and not limited in this invention. A thermostat may be provided in the present invention for maintaining the water temperature at a constant temperature.

The tissue extending means 5 includes: a driving motor 50 installed in the motor compartment 14 having a motor pulley 51 secured on a motor shaft of the driving motor 50, a driving roller 52 rotatably mounted in the dispensing compartment 15 of the container 1 by a transmission belt 53 coupled to the driving pulley 51 of the motor 50 for forwarding tissue 2 frontwardly as guided by the guiding roller set 21, and a follower roller 54 rotatably mounted in the container 1 above the driving roller 52 and rotatably engageable with and driven by the driving roller 52 as downwardly urged by a tensioning spring 55 secured in the container. The water sprayed from the nozzle 34 will be spread onto the follower roller 54 to transferrably moisturize the tissue 2 forwarded between the driving roller 52 and the follower roller 54.

The rollers 52, 54 may be made of elastomer materials, such as rubber, poly-urethane, etc.

Figure 4:
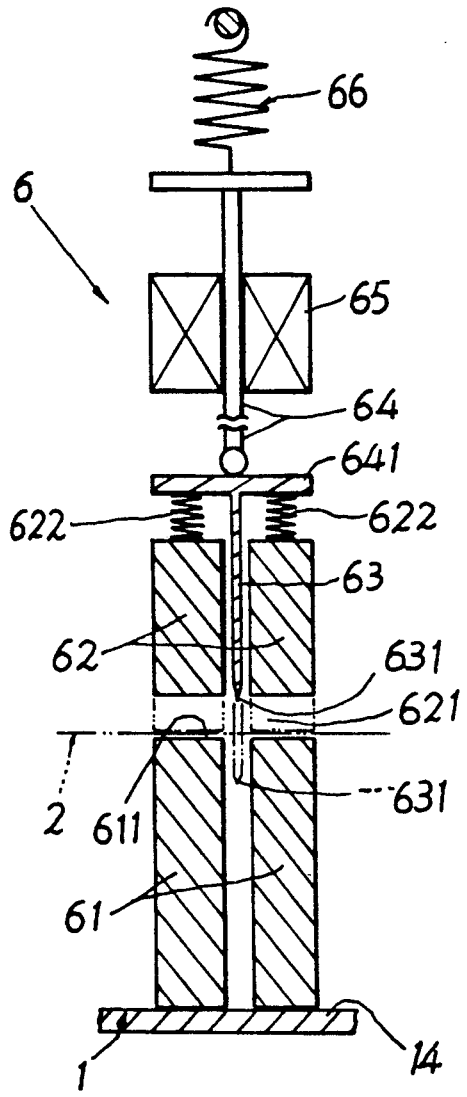
FIG. 4 is an enlarged view of a cutting means of the present invention.

The cutting means 6 as shown in FIGS. 2, 4 includes; a pair of anvil blocks 61 parallelly secured in a lower portion of the dispensing compartment 15 in the container 1, a pair of pressing blocks 62 parallelly suspended above the two anvil blocks 61 with an aperture 621 by a pair of block-suspending springs 622 secured to a lower arm member 641 of an actuating core 64 which is longitudinally formed in an electromagnet 65 and normally retained upwardly by a restoring spring 66 secured in an upper portion of the container 1, and a cutting blade 63 longitudinally protruding downwardly from the actuating core 64 between the two pressing blocks 62 having a lowest tip portion 631 of the blade normally positioned in the aperture 621 between the pressing block 62 and the anvil block 61 adjacent to a tissue 2 movably carried on an upper block surface 611 on each anvil block 61, with the cutting blade 63 being operatively lowered between the two anvil blocks 61 for cutting the tissue 2 passing through the aperture 621 between the pressing block 62 and the anvil block 61 when the electromagnet 65 is powered to electromagnetically attract the core 64, the pressing blocks 62 and the blade 63 downwardly.

As shown in FIG. 4, the tip 631 of the cutting blade 63 is normally approximating the tissue 2 slidably passing over the anvil blocks 61 and a compression stroke of the spring 622 generally equals to the aperture 621 between the pressing block 62 and the anvil block 61, thereby tensioning and flattening the tissue 2 on the anvil blocks 61 as resiliently loaded by the pressing blocks 62 for a smooth cutting operation of the blade 63 on the tissue 2.

If the automatic cutting means 6 as abovementioned is omitted, a cutting knife either made as a flat cutting edge or a sawtoothed cutting edge may be fixedly provided along the dispensing port 18 formed in the front panel 10 of the container 1 so that the tissue 2 can be manually cut by forcing the tissue along an acute cutting edge of the knife (not shown) for cutting the tissue at a desired length.

The present invention, if not necessary, may be served for merely moisturizing the tissue 2 by neglecting the warming and cooling means 4 for simplifying the structure and reducing the production cost therefor.

The control means 7 includes: a thermal selector 71 provided on the front panel 10 of the container 1 for selecting the operation of the heater or the cooler for spraying warm water or cold water onto the tissue; a sequence operating button 72 of a control circuit (not shown) provided on the front panel 10 for sequentially starting running of a pump 31 of the moisturizing system 3, simultaneously starting running of a driving motor 50 of the tissue extending means 5 for extending tissue 2 outwardly to a predetermined length to be cut by the cutting means 6, and actuating the electromagnet 65 for lowering the cutting blade 63 for cutting the tissue 2; and a low-level switch 73 provided in a lower portion of a water compartment 12 for operatively switching off power of the present invention for safety purpose when water level is lowered to the bottom of the container. After the electromagnet 65 is actuated for finishing the cutting of the tissue, the control circuit may automatically switching off the power for stopping the motor and pump running.

Naturally, the sequences may be mannally operated by providing plural buttons for starting the pump 31, initiating the motor 50 and actuating the electromagnet or solenoid 65 respectively.

The present invention may be modified by those skilled in the art without departing from the spirit and scope of this invention.

The present invention may be served as a portable table tissue in a family or in a restaurant. It may be provided in the toilet for hygienic uses.

Since the water is instantly sprayed onto the tissue ready for use, the mildew problem is overcome so that a "fresh" tissue may be served by this invention. The tissue paper or cloth 2 may be re-filled into the container 1 for reuse without disposing the container for preventing the production of waste material.

I claim:

1. A tissue supplier comprising:

a container having a tissue strip folded and stored in the container with the tissue strip extendible outwardly through a guiding roller set rotatably mounted in the container;

a moisturizing system provided in the container capable of pumping and spraying water onto the tissue extended outwardly by a tissue extending means mounted in the container;

a warming and cooling means fixed in the container for selectively heating or cooling the water handled in the moisturizing system;

a cutting means operatively cutting the tissue moisturized by water and extended outwardly by the tissue extending means to a predetermined length; and a control means for selectively and sequentially actuating the warming and cooling means, the moisturizing system, the tissue extending means and the cutting means for providing instantly moisturized tissue ready for use.

2. A tissue supplier according to claim 1, wherein said container includes: a tissue compartment formed in a central portion of the container for storing folded tissue strip therein, a water compartment formed in a side portion of the container for filling sterilized water therein, a heat-exchanger compartment positioned above the water compartment for installing the warming and cooling means therein, a motor compartment formed in a front portion of the container for securing a driving motor of the tissue extending means therein, a dispensing compartment positioned above the motor compartment for providing a spray nozzle of the moisturizing system and the cutting means in the dispensing compartment, an upper lid pivotally secured to an upper portion of the container by hinge for sealing an upper opening of the container, and a dispensing port slotted in a front panel formed on a front portion of the container for discharging cut tissue outwardly, and said front panel provided with a thermal selector and a sequence operating button of said control means.

3. A tissue supplier according to claim 2, wherein said moisturizing system includes: a pump installed in the water compartment for sucking and pumping water filled in the water compartment, a water conduit connected from the pump to a spray nozzle formed in the dispensing compartment, an adjusting valve formed in the water conduit, with the spray nozzle drilled with a plurality of perforations for spraying water drops for moisturizing the tissue.

4. A tissue supplier according to claim 2, wherein said warming and cooling means includes: a heater and a cooler installed in the heat-exhanger compartment for selectively warming the water flowing through a first branch conduit passing through the heater, or for cooling the water flowing through a second branch conduit passing through the cooler, thereby selectively producing warming water or cold water.

5. A tissue supplier according to claim 2, wherein said tissue extending means includes: the driving motor installed in the motor compartment having a motor pulley secured on a motor shaft of the driving motor, a driving roller rotatably mounted in the dispensing compartment of the container by a transmission belt coupled to the driving pulley of the motor for forwarding tissue frontwardly as guided by a guiding roller set, and a follower roller rotatably mounted in the container above the driving roller and rotatably engageable with and driven by the driving roller as downwardly urged by a tensioning spring secured in the container, said follower roller operatively spread with water sprayed from a spray nozzle of said moisturizing system for transferrably moisturizing a tissue forwarded between said follower and said driving rollers.

6. A tissue supplier according to claim 2, wherein said cutting means includes; a pair of anvil blocks parallelly secured in a lower portion of the dispensing compartment in the container, a pair of pressing blocks parallelly suspended above the two anvil blocks with an aperture by a pair of block-suspending springs secured to a lower arm member of an actuating core which is longitudinally formed in an electromagnet and normally retained upwardly by a restoring spring secured in an upper portion of the container, and a cutting blade longitudinally protruding downwardly from the actuating core between the two pressing blocks having a lowest tip portion of the blade normally positioned in the aperture between the pressing block and the anvil block adjacent to a tissue movably carried on an upper block surface on each said anvil block, with the cutting blade being operatively lowered between the two anvil blocks for cutting the tissue passing through the aperture between the pressing block and the anvil block when the electromagnet is powered to electromagnetically attract the core, the pressing blocks and the blade downwardly.

7. A tissue supplier according to claim 2, wherein said control means includes: a thermal selector provided on the front panel of the container for selecting the operation of a heater or a cooler for spraying warm water or cold water onto the tissue; a sequence operating button of a control circuit provided on the front panel for sequentially starting running of a pump of the moisturizing system, simultaneously starting running of a driving motor of the tissue extending means for extending tissue outwardly to a predetermined length to be cut by the cutting means, and actuating the electromagnet for lowering the cutting blade for cutting the tissue; and a low-level switch provided in a lower portion of a water compartment for operatively switching off power of the tissue supplier for safety purpose when water level is lowered to the bottom of the container.

* * * * *